United States Patent [19]

Anhalt et al.

[11] 3,950,059

[45] Apr. 13, 1976

[54] ZERO FORCE ELECTRICAL CONNECTOR

[75] Inventors: John W. Anhalt, Orange; James H. Curley, Costa Mesa, both of Calif.

[73] Assignee: International Telephone & Telegraph Corporation, New York, N.Y.

[22] Filed: June 27, 1975

[21] Appl. No.: 591,171

[52] U.S. Cl. ..... 339/75 M; 339/186 M

[51] Int. Cl.[2] ..... H01R 13/54

[58] Field of Search ..... 339/74 R, 75 M, 75 MP, 339/176 M, 176 MF, 176 MP, 186 M

[56] References Cited

UNITED STATES PATENTS

| | | | |
|---|---|---|---|
| 3,085,221 | 4/1963 | Kelly | 339/186 M |
| 3,587,037 | 6/1971 | Anhalt | 339/75 M |
| 3,594,698 | 7/1971 | Anhalt | 339/75 M |
| 3,915,538 | 10/1975 | Gruhn | 339/75 M |

*Primary Examiner*—Roy Lake
*Assistant Examiner*—Mark S. Bicks
*Attorney, Agent, or Firm*—Thomas L. Peterson

[57] ABSTRACT

An electrical connector having a zero force insertion upon mating of a first connector member and a second connector member. Each of the connector members contains contacts mounted in bores formed therein. The contacts in one of the connector members extend forwardly from the bores therein. A split insulator member in such connector member forms a pair of actuating plates. A rotatable actuating shaft is disposed between the plates and carries an actuating cam which, when the shaft is rotated, shifts the actuating plates apart to mate the contacting surfaces of the contacts in the respective connector members. A pair of additional actuating cams are rotatably mounted between the actuating plates on opposite sides of the actuating shaft. A gear on the shaft engages gears fixed to the additional cams so that the latter cams will rotate upon rotation of the actuating shaft, thereby providing an evenly distributed actuating force on the actuating plates preventing the plates from skewing against the connector housing. The additional actuating cams are rotatably mounted on polarizing posts which may be selectively mounted in various positions so that the connector member containing the posts may be coupled to only a predetermined mating connector member.

9 Claims, 7 Drawing Figures

ZERO FORCE ELECTRICAL CONNECTOR

BACKGROUND OF THE INVENTION

The present invention relates generally to an electrical connector and, more particularly, to an improved zero insertion force electrical connector.

The present invention comprises an improvement upon the zero force connector disclosed in U.S. Pat. No. 3,594,698 to Anhalt, assigned to the assignee of the present application. Such connector contains fixed contacts in one connector member and movable contacts in the mating connector member. A split insulat or member is provided in the second connector member forming a pair of actuating plates for the movable contacts. A cam shaft is rotatably mounted between the actuating plates in the second connector member. Rotation of the shaft causes the actuating plates to be shifted in opposite directions thereby moving the movable contacts into electrical engagement with the fixed contacts in the first connector member. The use of a single actuating cam in the connector between the actuating plates results in relatively high peak pressure loads against the plates and the cam bearings, thereby limiting the forces which can be applied in the connector and thus the number of contacts which the connector can contain. Further, on occasion the actuating plates skew against the connector housing so that complete actuation of the contacts is not accomplished.

In order to overcome the attendant disadvantage of the prior art zero force connector, the present invention provides a connector wherein an extremely large number of contacts may be utilized, yet peak pressures against the actuating plates are reduced and the actuating forces are evenly distributed against the plates thereby preventing the plates from skewing against the connector housing.

SUMMARY OF THE INVENTION

According to the principal aspect of the present invention, there is provided a zero insertion force electrical connector of the type described hereinabove wherein one or more additional actuating cams are provided in the connector member containing the movable contacts between the actuating plates therein. Preferably the actuating shaft of the connector is centrally positioned in the connector housing and two additional actuating cams are mounted for rotation about axes parallel to the axis of rotation of the actuating shaft on opposite sides of the shaft. The actuating shaft carries a gear which engages gears fixed to the additional actuating cams so that rotation of the actuating shaft is imparted to the additional actuating cams whereby camming forces are applied to the actuating plates at spaced locations thereon. This arrangement minimizes peak pressures against the plates and provides an evenly distributed actuating force thereon which prevents the actuating plates from skewing against the housing of the connector member. Thus, by the present invention a larger number of contacts may be effectively actuated in a zero insertion force connector than in the prior art connectors of this type.

According to another feature of the invention, the additional actuating cams are rotatably mounted on polarizing posts in the connector member which contains the movable contacts. These posts are slidably received in corresponding polarizing apertures formed in the mating connector member. The polarizing posts and the means forming the polarizing apertures in the mating connector member are capable of being selectively located in different positions so that one plug connector member in a wiring system containing number of such plug connector members may be coupled to only one predetermined mating receptacle connector member, to assure that unwanted connections are not made between the various connector members in the system.

DESCRIPTION OF THE PREFERRED EMBODIMENT

Figure 1:
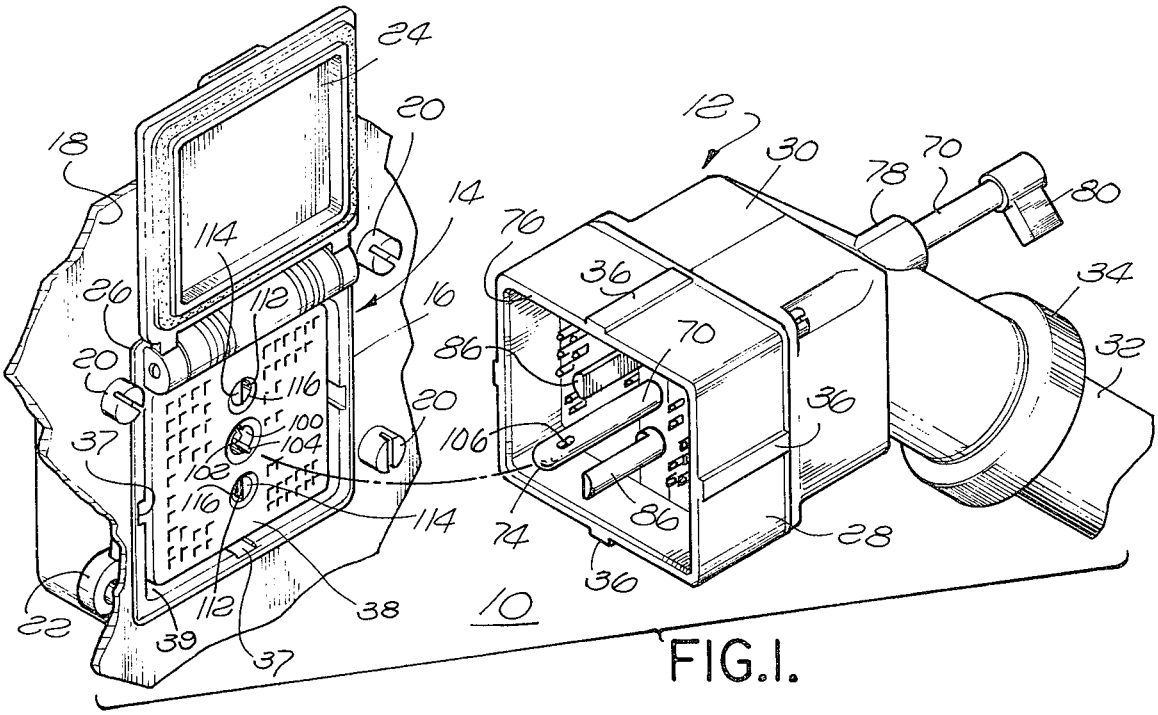
FIG. 1 is an exploded perspective view of the connector of the present invention prior to mating of the plug connector member and receptacle connector member, with the receptacle connector member mounted on a panel and with the plug connector member having a cable connected thereto which passes through a junction shell mounted on the rear of the connector.

Referring now to the drawings in detail, there is illustrated the zero insertion force electrical connector of the present invention, generally designated 10. The connector comprises a plug connector member 12 and a mating receptable connector member 14. The receptacle connector member includes a shell 16 which is mounted in a panel 18 by means of screws 20 which engage in threaded bosses 22 on the shell behind the panel, only one of such bosses being visible in FIG. 1. A spring-loaded cover 24 is pivotally mounted on the upper rim 26 of the shell for closing and sealing the shell when the plug connector member is disconnected from the receptacle connector member.

The plug connector member 12 includes a housing 28 having a split junction shell 30 mounted on the rear thereof. A cable 21 is connected to the junction shell 30 by means of a gland nut and cable seal 34.

Preferably the receptacle connector member shell 16 has a rectangular configuration. The housing 28 of the plug connector member 12 has a complementary configuration which allows the housing to be slidably inserted into the shell 16 upon mating of the two connector members. Keys 36 are formed on the outer surfaces of the four walls of the rectangular housing 28. These keys engage in corresponding keyways 37 formed on the inner surfaces of the walls of the shell 16 of the receptacle connector member 14 to assure proper alignment of the connector members when they are mated together.

Figure 6:
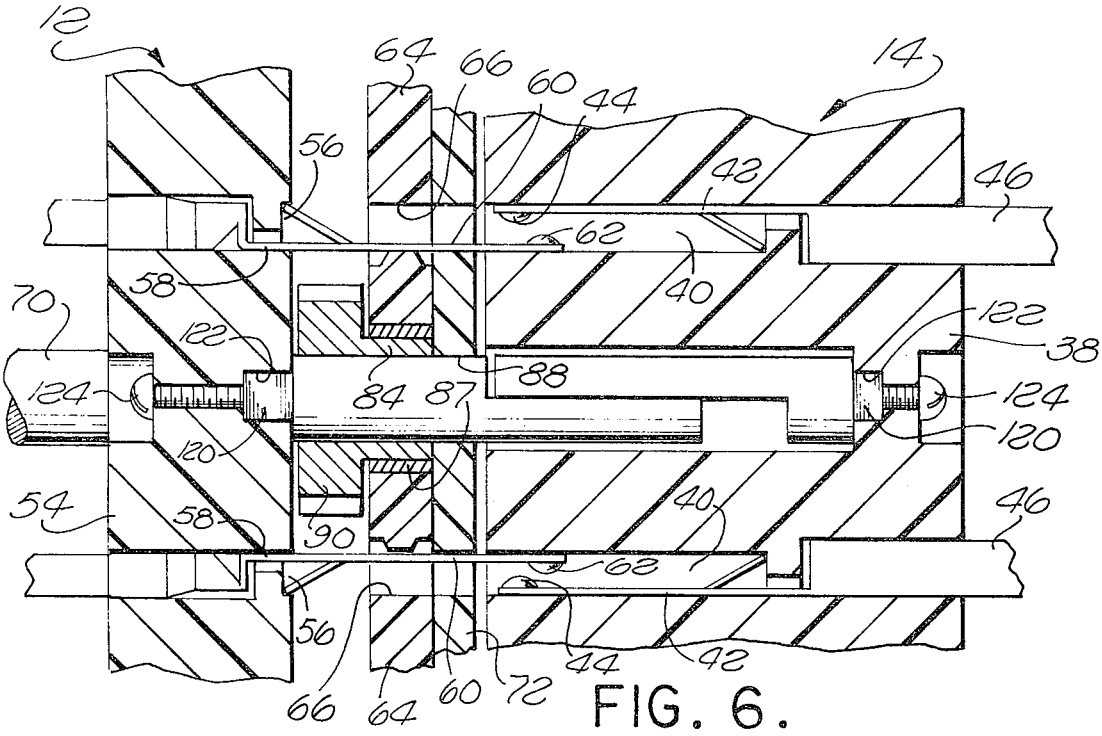
FIG. 6 is an enlarged, fragmentary, partial horizontal section taken along line 6—6 of FIG. 4, showing the contacts in the connector members disengaged.

As best seen in FIG. 6, the receptacle connector member 14 includes an insulator 38 fixedly mounted within the sell 16 and spaced therefrom to provide a rectangular space 39 which slidably receives the forward end of the housing 28 of the mating plug connector member 12. The insulator 38 is formed with a plurality of openings 40 which extend length wise between the front and rear faces of the insulator. Each opening contains an individual contact 42 which is formed with a contacting surface 44 that is disposed within the opening. Each contact terminates in a terminal portion 46 which may be connected to a wire, not shown.

The plug connector member 12 also comprises a fixed insulator 54 formed with a plurality of openings 56 which extend length wise therethrough and are aligned with the openings 40 in the receptacle member connector 14, when the plug and receptacle connector members are mated. A movable contact 58 is mounted in each of the openings 56. Each contact 58 includes an elongated beam portion 60 which extends outwardly from the opening 56 and terminates in a contacting surface 62. Each contact 58 has a rear wire termination portion 63. A pair of insulator plates 64 are slidably mounted in the plug connector member in front of and spaced from the insulator 54. Each plate is formed with a plurality of spaced apertures 66 through which the contacts 58 extend. A projection 68 is formed on one wall of each of the apertures 66 engaging the beam portion 60 of each contact 58.

As seen in FIGS. 1 to 5, an actuating shaft 70 is mounted in the plug connector member 12 between the plates 64 for rotation about a horizontally extending axis which is parallel to the contacts 58 and thus perpendicular to the face of the fixed insulator 54. Preferably the actuating shaft is centrally mounted in the plug connector housing 28 between the upper and lower edges of the fixed insulator therein. A retaining bracket 72 is fixedly mounted in the housing 28 in front of the movable plates 64 retaining the plates within the housing. The retaining bracket is formed with a central cylindrical bore 74 which functions as a bearing for rotatably supporting the actuating shaft 70. The forward end 74 of the actuating shaft extends a short distance beyond the forward edge 76 of the housing 28. The shaft extends rearwardly from the fixed insulator 54 and passes through a cylindrical boss 78 on the rear of the junction shell 30, as seen in FIG. 1. An actuating handle 80 is fixed to the rear of the actuating shaft.

Figure 3:
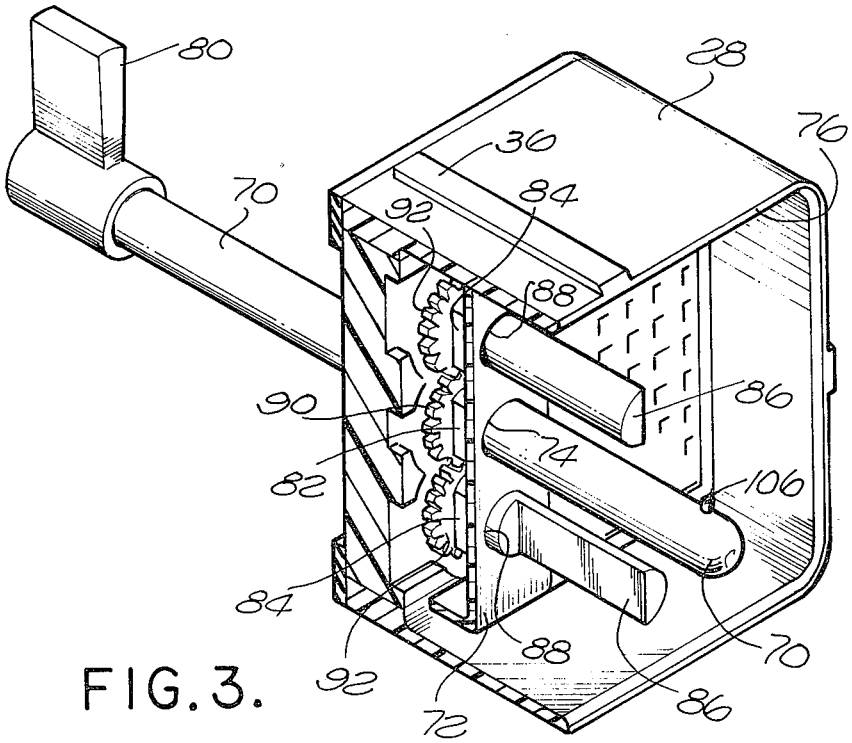
FIG. 3 is a perspective sectional view taken along line 3—3 of FIG. 2 showing further details of the interior of the plug connector member, but with the junction shell and cable removed therefrom.
Figure 2:
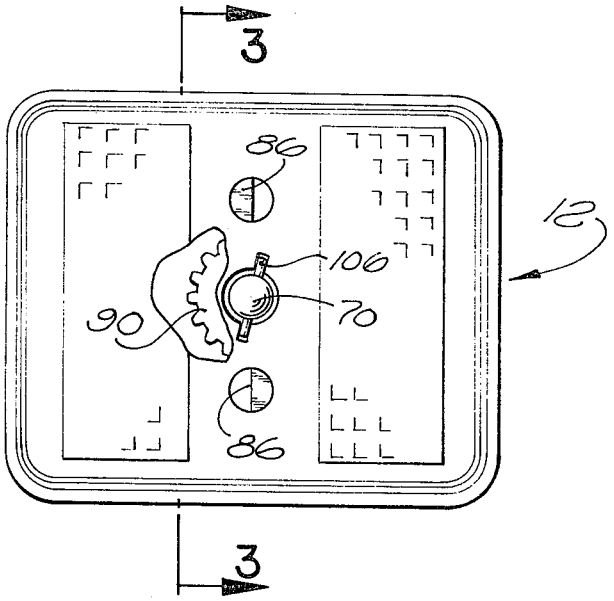
FIG. 2 is a front elevational view of the plug connector member illustrated in FIG. 1, with a portion of the retaining bracket therein removed to show the interior of the connector member.
Figure 4:
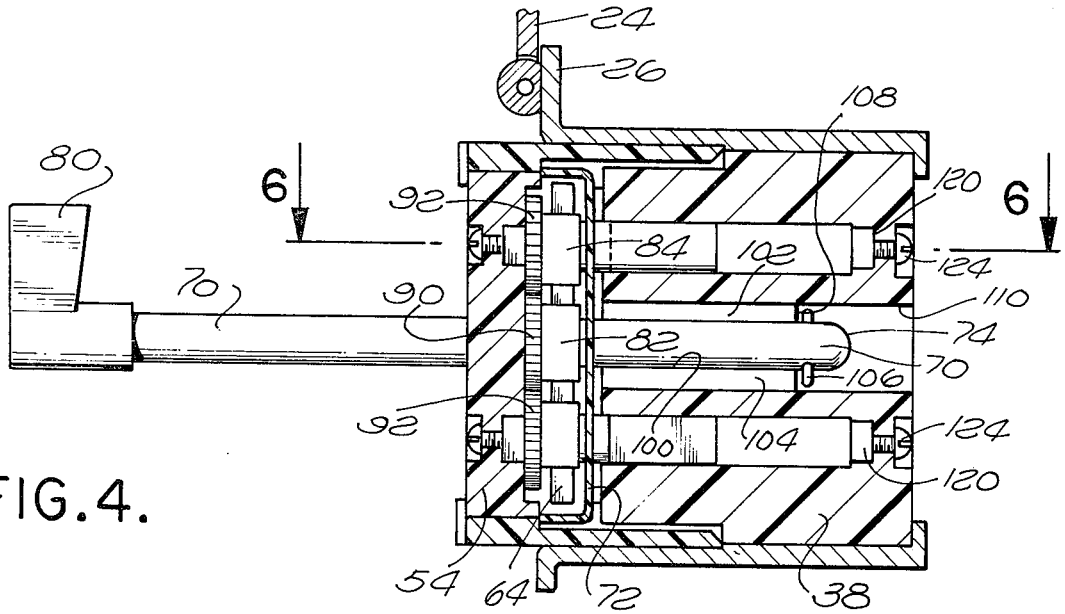
FIG. 4 is a longitudinal sectional view through the connector of the present invention with the plug and receptacle connector members fully mated, but prior to actuation of the contacts in the plug connector member.
Figure 5:
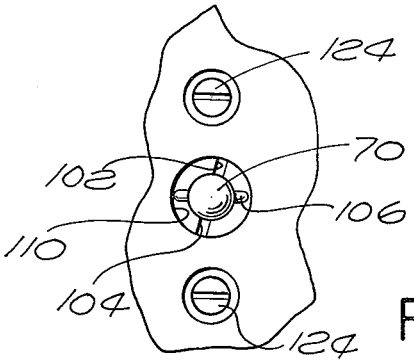
FIG. 5 is a fragmentary elevational view of the central rear portion of the receptacle connector member illustrated in FIG. 4.

As best seen in FIGS. 3 and 4, an actuating cam 82 is fixed to the actuating shaft 70 between the bracket 72 and the insulator 54. The cam may be either integrally formed on the shaft or may be fixed thereto by means of a pin, not shown.

Figure 7:
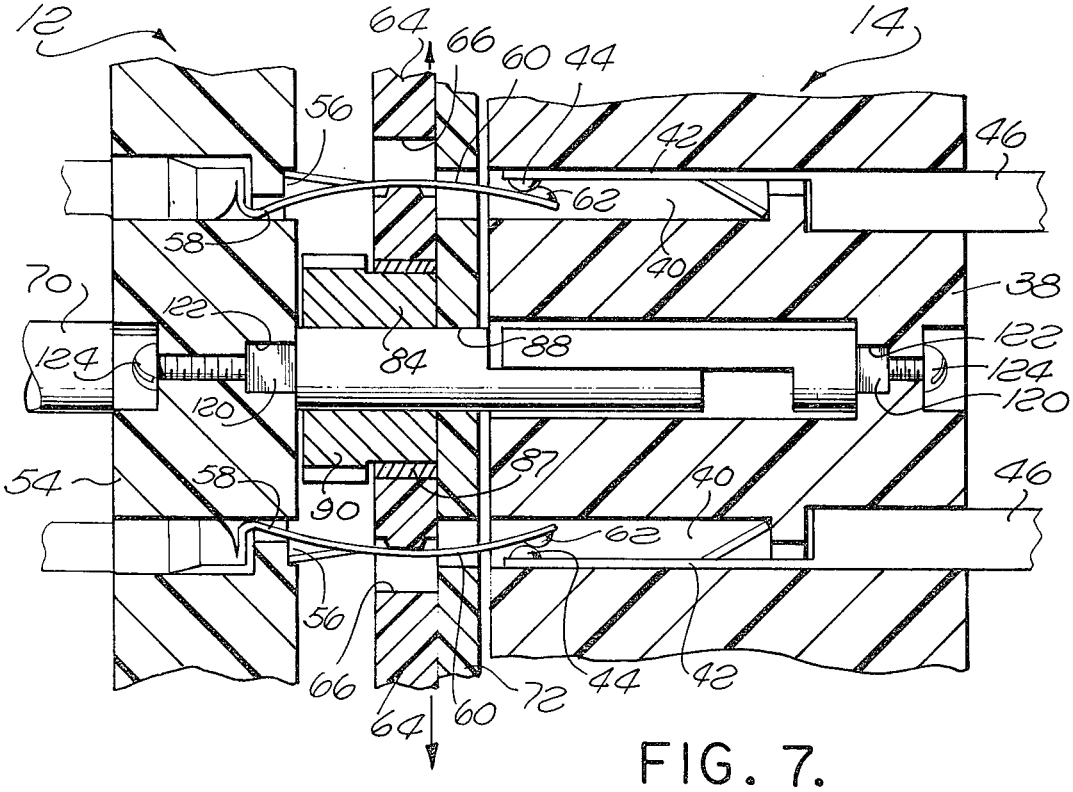
FIG. 7 is similar to FIG. 6 but shows the contacts in their engaged position.

As seen in FIG. 6, the plates 64 are normally positioned such that the contacting surfaces 62 of the movable contacts 58 are out of engagement with the contacting surfaces 44 of the fixed contacts 42. Thus, the connector members may be mated together with zero insertion force. When the cam shaft 70 is rotated 100°, the plates 64 shift in opposite directions as shown by the arrows in FIG. 7 thereby shifting the contacts 58 in tandem so that the contacting surfaces 62 and 44 of the respective sets of contacts will engage each other with a high unit force of contact. When the shaft is returned to its normal position illustrated in FIG. 6, the spring action of the contacts 58 will return the plates 64 to the position shown and the two sets of contacts will disengage. The structure and operation of the connector 10 described so far is similar to that disclosed in the aforementioned Anhalt patent.

In accordance with the present invention, additional rotatable actuating cams 84 are provided above and below the shaft 70 between the plates 64. The cams 84 are rotatably mounted on polarizing posts 86 between the retaining bracket 72 and the insulator 54. The posts 86 are parallel to the shaft 70 and equally spaced therefrom. The posts 86 are fixedly mounted in the insulator 54 by means which will be described later, and extend through openings 88 in bracket 72. The cams 84 are identical in configuration to the actuating cam 82 on shaft 70. The cams 84 engage cam bearings 87 on the plates 64. A gear 90 integral with cam 82 is fixed to the shaft 70. Corresponding gears 92 are integral with the cams 84 and are rotatable therewith on the posts 86. The gears 92 engage the central gear 90 on the shaft 70 so that when the shaft is rotated, the gears 90 and 92 will transmit the rotational movement of the shaft to the cams 84 whereby the cams 84 will rotate together with cam 82 the same number of degrees. Thus, rotation of shaft 70 will result in an equally distributed force being applied along the edges of the moveable plates 64, causing the plates to be uniformally shifted in opposite directions without skewing against the housing 28 or the bracket 72. Further because of the use of a plurality of cams, peak pressures against the plate 64 are decreased, thereby minimizing wear and increasing the life of the connector. Reference is again made to FIGS. 6 and 7, which illustrate the unactuated and actuated positions, respectively, of the outer cams 84 which operate together with central cam 82 to actuate the contacts in the plug connector member.

A cylindrical passage 100 extends lengthwise through the insulator 38 in the receptacle connector member in alignment with the actuating shaft 70 of the plug connector member. The passage 100 is dimensioned to slidably receive the shaft when the connector members are mated together. Diametrically opposed slots 102 and 104 are formed in the wall of the passage 110 offset 10° from the vertical axis of the connector. A transversely extending locking pin 106 is fixedly mounted in the forward end of the shaft 70. When the shaft is positioned so that the contacts in the plug connector member 12 are unactuated, as illustrated in FIG. 1, the locking pin 106 is offset from the vertical axis of the connector 10° in the same direction as the slots 102, 104 in passage 100 in the receptacle connector member. Thus, when the connector members are mated, the ends of the locking pin 106 will slide into slots 102 and 104 while the shaft 70 slides through the passage 100. When the connector members are fully mated together, as illustrated in FIG. 4, the pin 106 is positioned behind a vertically facing shoulder 108 in the insulator 38 formed by the bottom of a counterbore 110 of the passage 100. When the actuating cam 70 is rotated to actuate the contacts, in the manner previously described herein, the ends of the locking pin 106 shift out of alignment with the slots 102 and 104 and become positioned adjacent to the shoulder 108 thereby locking the two connector members together. From the foregoing it will be appreciated that the two connector members cannot be mated together unless the actuating shaft 70 is rotatably positioned as illustrated in FIG.

1 so that the pin 106 can be slidably receivable in slots 102 and 104 in the receptacle connector member. In this position of the shaft, the moveable contacts in the plug connector member are unactuated. Thus, the connector members can be mated only when the contacts are unactuated, thereby assuring that there is a zero insertion force of the plug connector member into the receptacle connector member. Further, due to the locking pin 106, the plug connector member cannot be disengaged from the receptacle connector member until the contacts in the plug connector member have been unactuated.

The forward ends of the polarizing posts 86 in the plug connector member which extend forwardly from the bracket 72 have a generally semicylindrical configuration, as best seen in FIGS. 1 and 3. The posts are slidably receivable in polarizing apertures 112 in the insulator 38 of the receptacle connector member 14 when the connector members are engaged. The polarizing apertures 112 are aligned with the posts and each has a semi-cylindrical configuration complementary to its respective polarizing post. Each semi-cylindrical polarizing aperture 112 is formed by a semi-cylindrical polarizing post 114 mounted within a cylindrical bore 116 in the insulator 38. The provision of the polarizing posts 86 and mating polarizing apertures 112 in the plug and receptacle members, respectively, assures that the two connector members will be properly interengaged and that only one plug connector member in a system including a plurality of connector members can be connected to a particular mating receptacle connector member 14.

The polarizing arrangement for the connector 10 is adjustable so that different connector constructions are not required to assure mating of the appropriate plug and receptacle connector members in a multi-connector system. Referring to FIG. 6, each polarizing post 86 has a square head 120 on its rear which may be mounted in four alternate positions in a complementary square recess 122 formed in the insulator 54 of the plug connector member. The post 86 is retained in the recess 122 by means of a screw 124 which is operable from the rear of the insulator 54. Thus, the posts 86 may be located rotationally in 16 alternate positions. The polarizing posts 114 in the receptacle connector member are adjustably positioned therein in the same manner as the posts 86 in the plug connector member so that the polarizing apertures 112 may be properly disposed to slidably receive the posts 86. Thus, by this arrangement 16 plug connector members in accordance with the invention can be mated to only predetermined ones of a plurality of 16 mating receptacle connector members thereby assuring that unwanted connections cannot be made between any connector members.

What is claimed is:

1. An electrical connector assembly comprising:

a first connector member having a plurality of contacts, each contact having a contacting surface and being secured in individual bores in said first connector member;

a second connector member having a plurality of contacts, each of said second connector member contacts being secured in individual bores in said second connector member and having a contacting surface extending from said bores;

each of said contacts in said second connector member being associated with a contact in said first connector member and being spaced apart from said associated contact when said connector members are mated;

means for moving said plurality of contacts in one of said connector members in tandem causing said first connector member contacting surfaces to mate with said second connector member contacting surfaces after said first connector member is secured to said second connector member comprising a split insulator member forming a pair of actuating plates; and driving means for moving said actuating plates in opposite directions, said driving means including an actuating shaft in said one connector member between said actuating plates rotatable about an axis extending parallel to said contacts, said shaft having an actuating cam fixed thereon engaging said plates, at least one additional actuating cam between said plates rotatable about a second axis parallel to said first-mentioned axis, and means for transmitting rotational movement from said shaft to said additional actuating cam.

2. An electrical connector assembly as set forth in claim 1 including:

a second additional actuating cam between said plates rotatable about a third axis parallel to said first and second axes, said additional actuating cams being disposed on opposite sides of said actuating shaft, said second additional actuating cam being rotatable by said rotational movement transmitting means.

3. An electrical connector assembly as set forth in claim 1 wherein:

said rotational movement transmitting means comprises a first gear fixed to said actuating shaft and a second gear fixed to said additional actuating cam and engaging said first gear.

4. An electrical connector assembly as set forth in claim 2 wherein:

said rotational movement transmitting means comprises a first gear fixed to said actuating shaft, and second and third gears fixed to said additional actuating cams, respectively, and each engaging said first gear.

5. An electrical connector assembly as set forth in claim 4 including:

first and second elongated posts fixed in said one connector member coincident with said second and third axes, respectively;

said first-mentioned additional actuating cam and said second gear being rotatable on said first post; and said second additional actuating cam and said third gear being rotatable on said second post.

6. An electrical connector assembly as set forth in claim 2 wherein:

said first axis is centrally located with respect to the tops and bottoms of said actuating plates;

said second and third axes are equally spaced from said first axis; and said actuating cams have the same configuration for uniformly moving said actuating plates in opposite directions upon rotation of said actuating shaft.

7. An electrical connector assembly as set forth in claim 5 wherein:

the forward ends of said posts have polarizing means thereon insertable into complementary polarizing aperture forming means in the other connector member when said connector members are mated.

8. An electrical connector assembly as set forth in claim 7 including:

means for selectively rotationally positioning said polarizing means and said polarizing aperture forming means.

9. An electrical connector assembly as set forth in claim 1 including:

a locking pin on the forward end of said actuating shaft extending transversely with respect thereto;

a passage in said other connector member slidably receiving said actuating shaft when said connector members are being mated; and a rearwardly facing shoulder in said other connector member surrounding said passage, said pin engaging said shoulder when said cam shaft is rotated to actuate said actuating plates thereby locking said connector members together.

* * * * *